United States Patent [19]

Meuldijk et al.

[11] Patent Number: 4,770,754

[45] Date of Patent: Sep. 13, 1988

[54] METHOD AND APPARATUS FOR ELECTROPLATING A METALLIC DEPOSIT ON INTERCONNECTED METALLIC COMPONENTS AND/OR METALLIZED PRODUCTS

[75] Inventors: Pieter W. Meuldijk, Av Vught; Willem N. H. Hoyer, An Den Bosch, both of Netherlands

[73] Assignee: Meco Equipment Engineers B.V., 'S-Hertogenbosch, Netherlands

[21] Appl. No.: 32,574

[22] Filed: Apr. 1, 1987

[51] Int. Cl.[4] ..... C25D 17/00

[52] U.S. Cl. ..... 204/224 R

[58] Field of Search ..... 204/206, 224 R

[56] References Cited

U.S. PATENT DOCUMENTS 4,376,017 3/1983 Urion ..... 204/224 R 4,405,410 9/1983 Sebastien ..... 204/224 R

*Primary Examiner*—T. M. Tufariello

*Attorney, Agent, or Firm*—Oblon, Fisher, Spivak, McClelland & Maier

[57] ABSTRACT

Method for electroplating a metallic deposit on interconnected or bandoliered elongate metallic and/or metallized products, whereby providing for non-conductive masking devices between the products, of which at least the parts which are in contact with the products consist of resilient material while, after providing for the said masking devices, the products are submitted to a contact with an electrolyte.

11 Claims, 4 Drawing Sheets

METHOD AND APPARATUS FOR ELECTROPLATING A METALLIC DEPOSIT ON INTERCONNECTED METALLIC COMPONENTS AND/OR METALLIZED PRODUCTS

FIELD OF THE INVENTION

This invention relates to a method for electro-deposition of a metal on interconnected oblong metal components and/or metallized products.

BACKGROUND OF THE INVENTION

Modern electronics and particularly telecommunication and computer technology require vast numbers of electrical contacts or connection systems comprising female and male contacts.

To ensure a maximum reliability for current passage between the female and male contacts, such contacts are provided with a coating of precious metal, usually gold or palladium or alloys thereof, at least in those areas of these components which come into engagement when contact is made. Frequently such metallic coatings are applied by electroplating the contacts.

For practical use it will be sufficient to electrodeposit precious metal only in those areas of female and male contacts which mate together when contact is established. The technology for plating select areas of components only is commonly called selective or functional plating.

The male parts of a connection system usually have the form of elongate objects, as square or round pins, blades, and the like. Existing technologies provide the capability to more or less accurately selectively electroplate precious metal onto such elongate components on all sides. However, in the majority of all connection systems, precious metal is only required on two opposite sides of a male contact which mate with the female contact.

In a complete connection system (that is, an assembly of several male and female contacts) in which gold is used as the contact coating material, the cost of the precious metal represents appr. 28% of the total connector system of which the largest part is required for coating the male parts of the system. As stated above, a large part of the gold presently applied to male connectors is plated in non-functional areas which are not used in the mating of the male contacts with their female counterparts.

OBJECT OF THE INVENTION

The present invention aims at an improved method and apparatus with the capability to electroplate a precious metal coating on elongate objects, such as square and round pins, blades and the like on those opposite sides of the components only which truly require such a precious metal coating to ensure proper functioning of a connecting system. It will be evident that realizing such a method and apparatus will result in an appreciable saving of the consumption of metal, usually precious metal, and hence will produce an important saving in the total costs of connection systems in which such elongate contact components are used.

DISCUSSION OF THE PRIOR ART

Several methods and apparatus shave been proposed for the deposition of metals on elongate components such as square or round pins, blades and the like. One method is to submerge only those parts of such components which require a metal coating into an electrolyte. This method is known as "controlled depth plating" and results in metal deposition on all sides of the submerged components, including those areas where no metal coating is required. Moreover, it is difficult to accurately control the level of the electrolyte in which the components are submerged, since, in order to obtain an acceptable metal deposition rate, solution agitation is necessary, which will disturb the solution level. The metal deposited in such a controlled depth system will further show an uneven distribution resulting in an additional loss of metal, usually precious metal. Complicated shielding systems may overcome this disadvantage somewhat, but it will make controlled depth plating more expensive and critical.

British Pat. No. 1,562,179 shows a method whereby those areas of elongate contact components that require a precious metal coating are first covered by a removable non-conductive mask. In a next step the components are electropainted and cured at elevated temperature. The electropaint does not cover the area protected by the removable mask, which in a subsequent step can be removed. The now exposed metal area can then be plated by conventional means with metal, usually precious metal.

Not only is this known method very elaborate, but several disadvantages are inherent to this method. In practice residues of the removable mask appear to reduce the quality of the subsequent metal deposit. Furthermore, the curing operation at elevated temperatures can influence the mechanical properties of the base material of which the components were manufactured. Finally, it is difficult to accurately apply the removable mask and hence to obtain the desire accuracy. Since it is extremely difficult to remove the coating of electropaint, it makes subsequent tinplating of other areas of the contact components very expensive and almost impossible.

U.S. Pat. No. 4,064,019 describes a method whereby interconnected metal components are guided along a porous material wetted with an electrolyte of the metal that must be plated. The porous material is applied to the outside of a cylindrical roller, the inside of which is acting as an anode. During the transport along the roller surface, the cathodically connected components will be plates in the area which is in contact with the porous outside of the roller. The electrolyte in the porous material in continuously renewed.

This method is suitable for plating formed areas of female contacts which require a metal coating, usually precious metal, over a very limited area on one side only. Should a double sided plating be required, then a second operation is necessary.

Further, during transport of the components along the porous material on the roller, a small electrolyte wave will be formed in the direction of travel which will result in undesired metal deposition on the forward side of the components. If a second plating treatment of the opposite side of the contact is required, the same phenomena will happen. In practice this results in a metal deposit on all sides. The small contact area between component and cylindrical porous material makes an even deposition of metal over a larger area (such as is required on square or round pins or blades and the like for male connectors virtually impossible.

A similar method is described in U.S. Pat. No. 4,452,684, in which the interconnected components are guided along a device provided with an outer surface of porous material and whereby the device can have a flat surface. This method enables plating of elongate components over a certain length, but it does not prevent the formation of an electrolyte wave in front of the components seen in the direction of travel. This is the more so in the proposed method of this patent, since electrolyte is introduced from the inside of the device into the outer layer of porous material. Moreover, if, as is usual in plating elongate components such as square or round pins, blades and the like, two sided metal deposition is required, two operations are required, and the loss of metal, usually precious metal, on non-functional areas will be considerable.

U.S. Pat. No. 4,364,801 describes a method for the selective deposition of metal on interconnected contact pins, whereby the interconnected pins are transported through a cell in which they are on one side exposed to a gas or air stream and on the other side to an electrolyte stream. It is the object of this method to plate the components on one side only. However, due to turbulence of gas and electrolyte streams, wetting with electrolyte and hence metal deposition on the sides of the pins can not be prevented. Further, the turbulences of the gas stream will cause irregular electrolyte supply to the areas of the pins to be plated, which will lead to uneven metal distribution on the plated area. Finally, if two sided plating is required, which is common for connector pins, double treatment is necessary.

U.S. Pat. No. 3,340,162 shows a method in which interconnected contact pins are guided around a wheel which is provided with spring loaded retractable pins which engage with holes in the strip of interconnected contact pins in order to precisely position the pins in relation to the wheel. During the rotation of the wheel with interconnected contact pins, electrolyte is jetted from small tubes radically in outward direction on those areas of the contact pins which require plating.

Due to slight variations in distance between the interconnected contact pins and variability of the diameter of the pilot holes in the strip of interconnected contact pins, there will be a variation of distance between areas of pins to be plated and the exit of the small tubes which jet the electrolyte. This will result in an uneven thickness of the plated metal, usually precious metal, on the contact pins.

Moreover, the solution jetted onto the area to be plated will spray droplets onto areas not requiring plating and cause metal deposition on these areas. Finally, for double sided plating two operations are necessary.

European Pat. No. 0,060,591 describes a method for selective plating of stripmaterial or interconnected components by guiding the strip over a wheel shaped masking device which is subdivided into segments and has apertures on its circumference corresponding with the desired pattern to be plated on the stripmaterial or interconnected components. Electrolyte is jetted from the inside of the masking device onto the exposed area of the products in the apertures. Although this method provides the possibility to accurately apply material on a strip or on interconnected components, two operations are required for plating metal on both sides of interconnected square or round pins, blades and the like.

SUMMARY OF THE INVENTION

The present invention is characterized by providing for non-conductive masking devices between the products, whereby the parts of these masking evices that are in contact with the neighbouring products consists of resilient material, whilst after providing for said masking devices the products are submitted to a contact with an electrolyte.

By the invention there is obtained a method for fast and accurately plating a metal on two opposite sides of a component or on one side only at choice, resulting in a considerable saving in metal, usually precious metal, compared with prior art technology. In most cases of double sided plating the saving in precious metal is appr. 50%.

A further aspect of the present invention relates to an apparatus in which the method can be used to its greatest advantage. The apparatus provides means for lengthwise transport of the bandoliered or otherwise interconnected elongate components, means for placing and removing non-conductive masking devices in between the elongate components synchronous with the transport of the bandoliered or otherwise interconnected product, and means to bring the objects to be plated and the masking devices in between them in contact with electrolyte, on one side or two sides simultaneously at choice.

A more detailed description of the invention will be given with reference to the figures.

DETAILED DESCRIPTION OF THE PRESENTLY PREFERRED EMBODIMENTS

Figure 1:
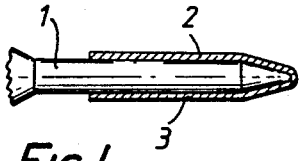
FIG. 1 shows an example of an elongate product in the form of a male contact pin.
Figure 2:
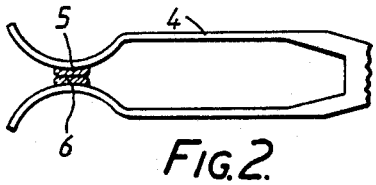
FIG. 2 shows a female contact spring suitable for mating with the contact pin of FIG. 1.

In FIG. 1 an elongate product in the form of a square contact pin 1 is partially shown. The pin 1 has been plated with precious metal 2-3 on two opposite sides, the other two sides not having been plated. This contact pin is suitable for mating with a female contact, for instance the U-shaped contact spring 4 of FIG. 2. Both sides of the contact spring entry side have been bent and provided with a precious metal coating 5-6 on the opposite sides of the bend areas.

Figure 3:
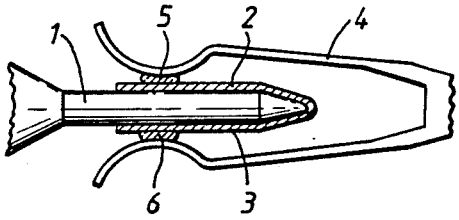
FIG. 3 shows the male contact pin and female contact spring in mated position.

When the contact pin 1 is mated the spring 4, as shown in FIG. 3, the precious metal layers 2 and 3 of the pin 1 will mate with the precious metal layers 5 and 6 of the spring 4 and insure reliable contact and current passage.

It will be evident from these figures that any precious metal on the non-plated sides of the pin 1 would be spillage, since these sides do not contribute in any form in making contact between the pin 1 and the spring 4. To guarantee perfect contact, however, the precious metal must cover a certain length (usually 3–5 mm) on the pin 1,the travel length during insertion. Female contacts usually require much more restricted areas to be covered with precious metal.

Figure 4:
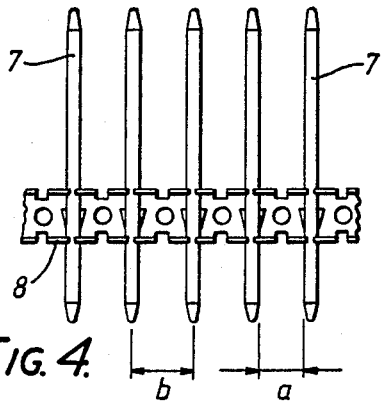
FIG. 4 shows an example of interconnected elongate products formed by loose pins assembled in a bandolier.
Figure 5:
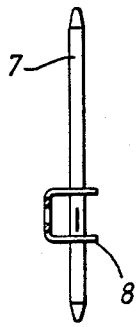
FIG. 5 shows a side view of FIG. 4.

Elongate products requiring a precious metal coating, such as contact pins and blades described earlier, are frequently produces as separate loose parts, such as the elongate parts 7 in FIG. 4, and subsequently interconnected by a bandolier 8 of FIGS. 4 and 5, which bandolier is usually U-shaped as indicated in FIG. 5. Parallel limbs of the bandolier 8 serve to fix the elongate products 7 as indicated in FIGS. 4–5 in such a way that they are spaced on a pitch "b" with an inbetween free distance "a".

Figure 6:
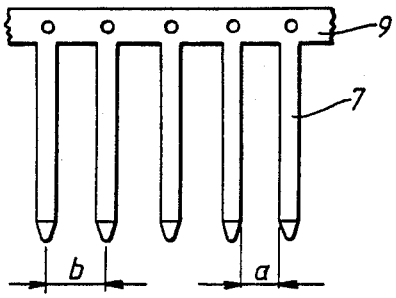
FIG. 6 shows another example of interconnected elongate products formed by pins, produced by stamping, leaving them interconnected by a strip of the original material.

An alternative possibility is to stamp the elongate products and interconnection from stock material as indicated in FIG. 6 for the pins 7, still attached to be interconnection 9. Also here the pitch is indicated with "b" and the free distance in between the parts with "a".

Figure 7:
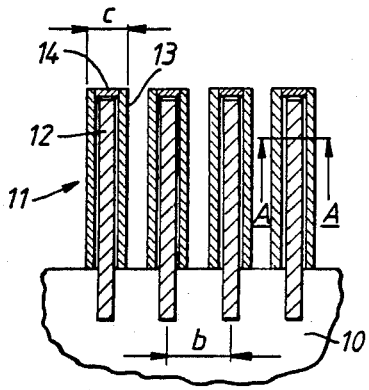
FIG. 7 shows a few masking devices placed in between elongate products on a carrier.

FIG. 7 shows a support 10 carrying a number of masking devices 11, each comprising a non-flexible pin 12 surrounded by resilient material 13 in this case consisting of pieces of resilient or elastic tube.

The pitch "b" of the pins of the masking devices is equal to the pitch of the elongate products to be plated at opposite sides with precious metal.

The tubes 13 surrounding the pins 12 are made of resilient non-conductive material (such as rubber, silicon rubber, polyethelene, soft PVC or similar materials) and can be closed on the open top side with silicon paste 14 or similar material. The outside diameter "c" of the tubes 13 is larger than the free distance "a" between the elongate products 7.

Preferably the cross-section of the pins 12 is not round, but such that in a first direction of a line interconnecting adjacent pins 12 the dimension of the pins 12 is smaller than the internal diameter of the tubes 13, and the dimension perpendicular to the first direction the pin 12 at least over a certain length of the pin is appr. equal to the internal diameter of the tubes 13.

Figure 8:
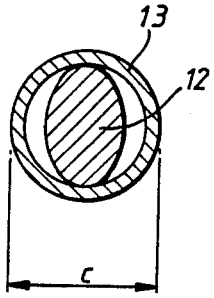
FIG. 8 shows a cross section of an embodiment of a masking device.
Figure 9:
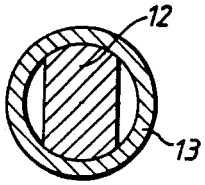
FIG. 9 shows a cross section of a second embodiment of a masking device.

The pins 12 may have an elliptical shape, as shown in FIG. 8 or be provided with two flat sides, as shown in FIG. 9. A third form with flat sides is indicated in FIG. 10.

Figure 10:
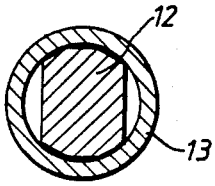
FIG. 10 shows a cross section of a third embodiment of a masking device.

It is evident that the possible shapes of the pins 12 are not limited to the ones shown in FIGS. 8–9–10. However, it will also be clear that preferably the tubes 13 can be freely compressed somewhat upon engagement with the elongate products to be plated, without interference of the non-flexible pins 12.

Figure 11:
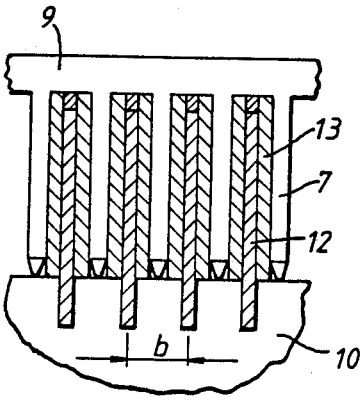
FIG. 11 shows a few masking devices placed in between some elongate products.
Figure 12:
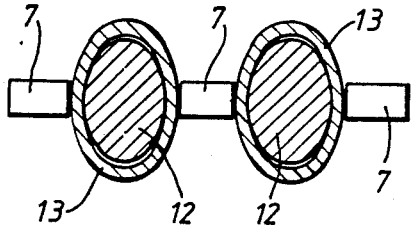
FIG. 12 shows a cross section of some masking devices placed in between elongate products.

When the masking devices consisting of the pins 12 and the tubes 13 are introduced on the open spaces "a" (FIGS. 4 and 6) in between the elongate products 7 as shown in FIG. 11, the tubes 13 will be compressed by the facing sides of the elongate products 7, very clearly illustrated in FIG. 12, resulting in perfect masking under light pressure of the facing sides of the elongate products 7 by the tubes 13.

When the areas of the elongate components not masked by the tubes are immersed into an electrolyte, or if electrolyte is jetted onto these areas, electrodeposition of metal, usually precious metal, on the areas on the two opposite sides of the elongate products 7 is obtained.

Figure 13:
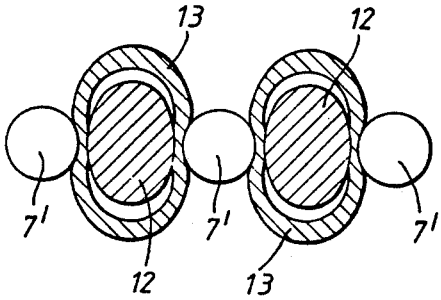
FIG. 13 shows a cross section of masking devices placed in between round elongate products.
Figure 14:
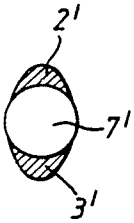
FIG. 14 shows a cross section of a round pin plated with the apparatus of this invention whereby the thickness of the plated metal has been exaggerated.

Although elongated products 7 shown in FIG. 12 have a rectangular or square cross section, the invention is equally applicable for processing elongate products 7′ with a round cross section as shown in FIGS. 13 and 14. Also here use of masking devices according this invention result in considerable precious metal savings. Also oval, polygonal or other cross sections could be processed according to the present invention.

After processing elongate products in the manner outlined above, metal deposition will be obtained on masked elongate pins 7′ on two opposite sides, indicated with 2′-3′ in FIG. 14, in which the thickness of the metal deposit has been exaggerated for better illustration.

Figure 15:
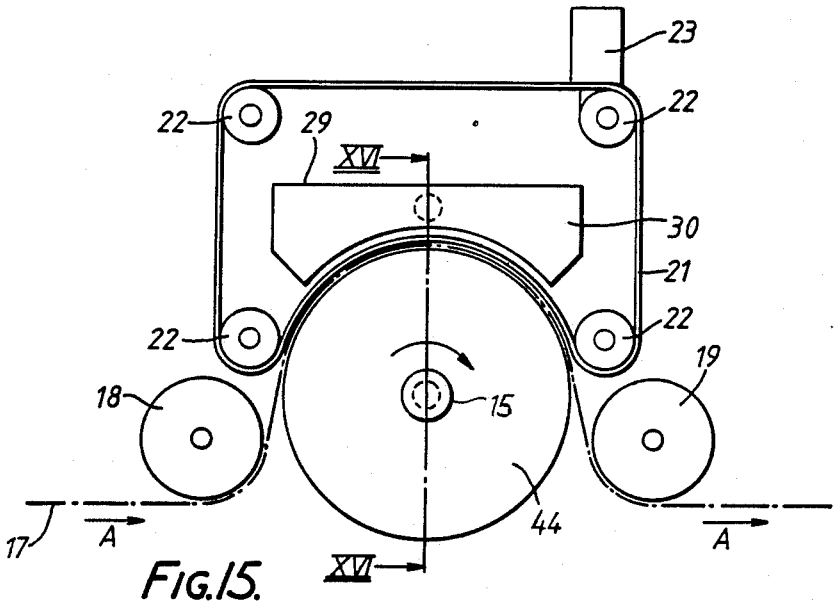
FIG. 15 shows schematically a plan view of an apparatus for performing the method according to the invention.
Figure 16:
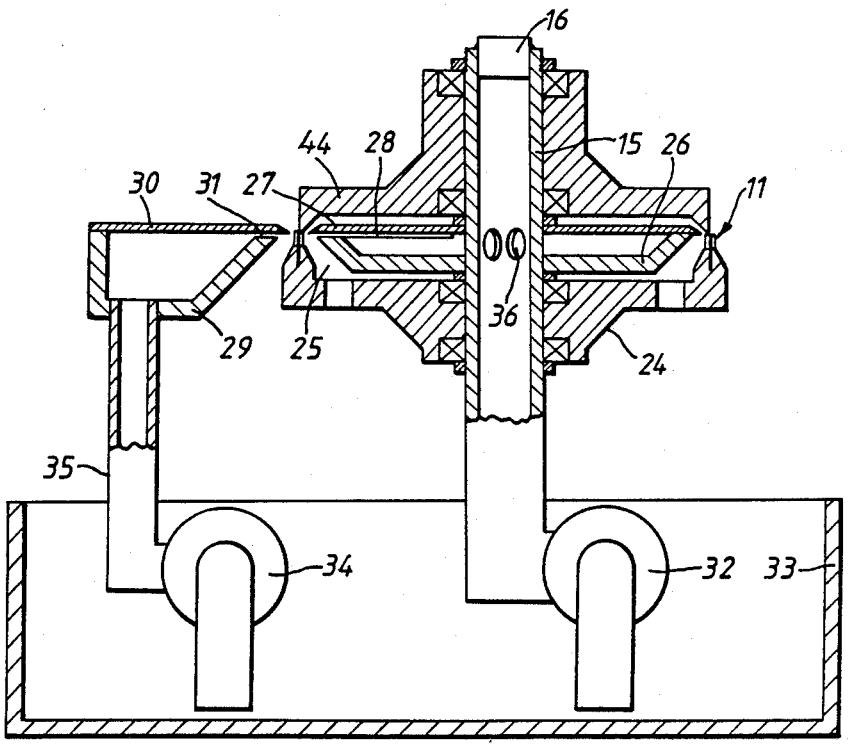
FIG. 16 shows schematically on a large scale a cross section of the apparatus of FIG. 15 along the line XVI—XVI.

An apparatus particularly suitable for applying the method of this invention is shown in FIGS. 15–16. This apparatus comprises a guide wheel 44 freely rotable on bearings on a preferably vertical hollows shaft 15, the upper side of which is closed by a plug 16.

The guide wheel 44 serves to conduct the interconnected to bandoliered elongated products, indicated in FIG. 15 schematically by a stripe-dot line 17. The interconnected or bandoliered elongate products 17 are brought into engagement with the guide wheel 44 by two auxiliary rollers 18 and 19 over an angle in this figure of appr. 160° and are transported during processing in the direction of arrow A in FIG. 15.

Figure 19:
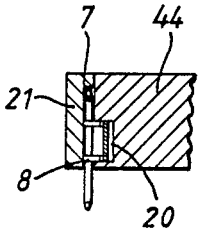
FIG. 19 shows a cross section of part of the guide wheel of FIG. 18.
Figure 20:
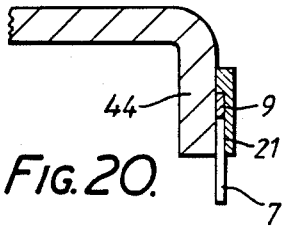
FIG. 20 shows a cross section of part of the guide wheel of FIG. 18 with an alternative form.

In case the bandoliered products are assmebled as indicated in FIGS. 4 and 5, a slot 20 will be required to accomodate the U-shaped section of the bandolier 8 as indicated in FIG. 19. However, if a configuration of interconnection and elongate components as shown in FIG. 6 must be processed, the circumference of the guide wheel 44 can be smooth as shown in FIG. 20.

In both examples the interconnected or bandoliered elongate products are pressed against a part of the circumference of the guide wheel 44 by a masking belt 21 of non-conductive material which is further guided over four rollers 22, of which at least one can be driven by a motor 23.

As can be seen most clearly from FIGS. 19 and 20, the interconnected or bandoliered elongate products are masked by masking belt 21 in such a manner that only those areas protruding below the guide wheel 44 are exposed to the electrolytic process.

Figure 17:
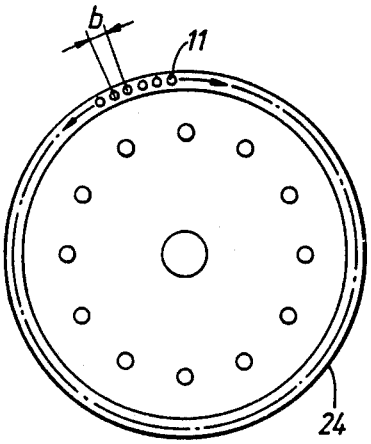
FIG. 17 shows a top view of a disc shaped member, carrying the masking devices, of the apparatus of FIGS. 15–16.
Figure 18:
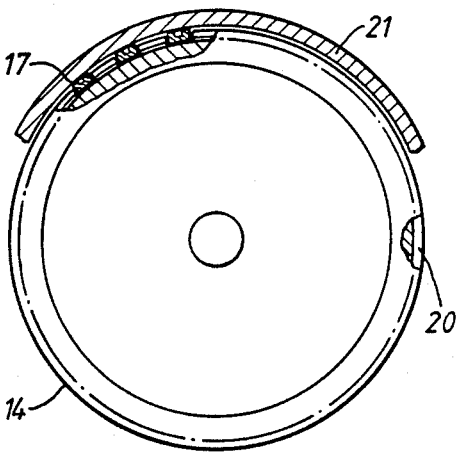
FIG. 18 shows partly in plan view and partly in section a guide wheel of the apparatus of FIGS. 15–16, along which the interconnected or bandoliered elongate products are guided during processing.

Underneath the guide wheel 44 is positioned a carrier wheel 24 also rotable about the hollow shaft 15. The carrier wheel 24 serves as a carrier for the masking devices 11, which are mounted on a regular pitch distance "b" along the outside of the carrier wheel 24 as indicated in FIG. 17 for some of the masking devices 11.

In a chamber 25 provided between the wheels 44 and 24, a disc-shaped reservoir 26 is mounted. The reservoir 26 is covered on top with a circular plate 27 which serves also as an insoluble anode and which defines over part of its circumference in combination with the reservoir 26 a slot shaped exit or sparger 28. Both the cover plate 27 and the reservoir 26 are stationary. The exit slot or sparger 28 is positioned at a height such that solution jetted from the slot 28 will hit that area of the interconnected or bandoliered elongate products extending below the guide wheel 44.

Opposite the exit slot or sparger 28 another sparger is positioned comprising a stationary reservoir 29 closed on its upper side by an insoluble anode plate 30. Between the anode plate 30 and the upper side of the reservoir 29 is a slot shaped exit or sparger 31 exactly opposite the slot 28 and which, as is shown in FIG. 15, is positioned concentrically around the centerline of the guide wheel 44 and extends over substantially the larger part of the arc in which the interconnected or bandoliered elongate products are engaged on the guide wheel 44. During operation, electrolyte is jetted from the slot 31 of the reservoir 29 and from the slot 28 of the reservoir 26 onto the opposite sides of those areas of the interconnected or bandoliered elongate products which extend below the masking belt 21 and the guide wheel 44.

The interior of the hollow shaft 15 is in communication with a pump 32 which extracts electrolyte from a storage tank 33. By means of a second pump 34, electrolyte can be pumped under pressure from the storage tank 33 through a hollow pipe 35 into the reservoir 29. The electrolyte extracted from the storage tank 33 by the pump 32 is fed through the hollow shaft 15 and apertures 36 under pressure into the reservoir 26.

During operation, the interconnected or bandoliered elongate products are transported in the direction of arrow A, in FIG. 15, through the apparatus described above, whereby the masking belt 21 can be driven by the motor 23 to avoid drag between the masking belt 21 and the interconnected or bandoliered products.

During the transport of the interconnected or bandoliered elongate products, the parts of these products extending below the guide wheel 44 will automatically engage with the masking devices 11 mounted on the carrier wheel 24 which extend upwards, and by this action cause the carrier wheel 24 to rotate in synchronisation with the guide wheel 44 and the products.

The masking devices 11 will eliminate all metal deposition on the facing sides of the interconnected or bandoliered products when electrolyte is jetted from the slots 28 and 31 on the interior and exterior exposed areas of the products and in this way electroplate the desired functional areas only. It will be obvious that it is necessary to connect the interconnected or bandoliered products with the negative pole of one or more rectifiers, whereas the unsoluble anode plates 27 and 30 must be connected to the positive pole(s) of this(these) rectifier(s). It is advantageous to connect both anodes to the positive poles of two individual rectifiers, with a common negative contact to the products to be plated. This permits complete flexibility from plating one sides only, both sides with the same thickness or with different thicknesses.

If desirable the guide wheel 44 and/or the carrier wheel 24 can be connected to a drive motor. However, in most cases it is sufficient to pull product strip 17 lengthwise through the apparatus and produce rotation the wheels 44 and 24 simultaneously.

Possible variations in pitch of the interconnected or banoliered elongate products can be easily absorbed by the resilience of the masking devices.

It will be clear to a person skilled in the field that variations and/or additions on the present invention are possible.

Figure 21:
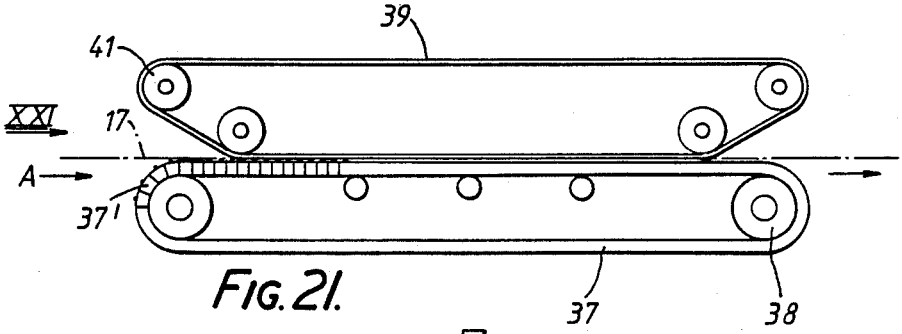
FIG. 21 shows a further example of an apparatus for performing the method according to this invention in which for simplicitty the bandolier for the elongate components has been omitted.
Figure 22:
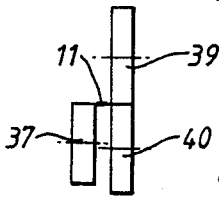
FIG. 22 shows a view of the apparatus of FIG. 21 in the direction of arrow XXI.

As an example, in FIGS. 21 and 22 an apparatus is shown comprising an endless belt 37 assembled from segments 37', which is guided over guide wheels 38 rotatable around horizontal shafts, each of the segments carrying a number of masking devices 11 of the above described configuration.

The interconnected or bandoliered elongate products are guided between two masking belts 39 and 40, positioned on top of each other and guided around wheels 41. It will be clear that, in this application of the invention, the areas of the products which do not require any plating at all will be captured between the masking belts 39 and 40, whereas the areas of the interconnected or bandoliered elongate products that require the two-sided plating extend beyond these masking belts and will engage into the masking devices carried by the belt 37. Once these components are engaged and masked in the way described, they are transported along sparger-anodes which are not shown in FIG. 21, but which jet electrolyte in a similar fashion on the products as described for the circular arrangement.

In a further version of the present invention, the interconnected or bandoliered components could be transported intermittently or stepwise and placed over or opposite a carrier with masking devices that can be moved towards and from the components, to place the masking devices into engagement with the components or remove them from these components subsequently, whilst during the period of engagement the jetting operation and hence the plating is carried out with the aid of suitably positioned anode-sparger systems.

We claim:

1. Apparatus for electroplating a metallic deposit on interconnected or bandoliered elongate metallic and/or metallized products, said apparatus comprising:

(a) first means for guiding and displacing the elongate products along a first predetermined path;

(b) a plurality of masking devices each one of which comprises a solid, non-flexible pin surrounded by a material in the shape of a tube, said plurality of masking devices being attached in a regular pattern to an endless member;

(c) second means for guiding and displacing said endless member along a second predetermined path a part of which coincides that a part of said first predetermined path so that each one of the elongate products is received between and contacts two adjacent ones of said plurality of masking devices; and (d) third means for supplying electrolyte to the elongate products while the elongate products are moving along said part of said first predetermined path.

2. Apparatus as recited in claim 1 wherein:

(a) said first means comprising a main guide wheel that is rotatable about a first axis and a plurality of auxiliary guide wheels that provide guidance for the elongate products along at least a part of the circumference of said main guide wheel and (b) said second means comprise a carrier wheel that is rotatable about said first axis.

3. Apparatus as recited in claim 1 wherein at least one masking belt made of non-conductive material cooperates with said main guide wheel to prevent metal deposition on those areas of the elongate products where no deposit is desired.

4. Apparatus as recited in claim 1 wherein:

(a) a space is provided between said main guide wheel and said carrier wheel;

(b) said space is in communication with said third means; and (c) said third means comprises a slot-shaped exit for jetting electrolyte outwardly towards the elongate product and said plurality of masking devices.

5. Apparatus as recited in claim 4 wherein said third means further comprises a stationary anode.

6. Apparatus as recited in claim 5 wherein said stationary anode is a part of said slot-shaped exit.

7. Apparatus as recited in claim 2 wherein said third means comprises a reservoir placed outside said main guide wheel and a slot-shaped exit concentric to said first axis for jetting electrolyte inwardly towards the elongate products and said plurality of masking devices.

8. Apparatus as recited in claim 7 wherein said third means further comprises a stationary anode.

9. Apparatus as recited in claim 8 wherein said stationary anode is a part of said slot-shaped exit.

10. Apparatus as recited in claim 1 wherein, in the positions where no elongate products are received between adjacent ones of said plurality of masking devices, there is some space between the inner wall of the flexible, resilient material and the outer wall of the solid, non-flexible pin in the direction of movement of the elongated products.

11. Apparatus as recited in claim 1 wherein:

(a) said first means comprise two cooperating masking belts made of non-conductive material between which, during operation, the area of the elongate products requiring no metal deposition are clamped and (b) said second means comprises another belt that carries said plurality of masking devices between said two cooperating masking belts.

* * * * *

UNITED STATES PATENT AND TRADEMARK OFFICE

CERTIFICATE OF CORRECTION

PATENT NO. : 4,770,754

DATED : Sep. 13, 1988

INVENTOR(S) : Pieter W. MEULDIJK

It is certified that error appears in the above-identified patent and that said Letters Patent is hereby corrected as shown below:

On the Title Page, Item [30]:

The Foreign Application Priority Data has been omitted; please add as follows:

-- Apr. 2, 1986 [NL] Netherlands ..... 8600838 --

Signed and Sealed this

Seventh Day of February, 1989

*Attest:*

DONALD J. QUIGG

*Attesting Officer*

*Commissioner of Patents and Trademarks*